US012121769B2

(12) United States Patent
Luo

(10) Patent No.: US 12,121,769 B2
(45) Date of Patent: Oct. 22, 2024

(54) LIFTING MECHANISM FOR TREADMILLS

(71) Applicant: Shenzhen Axo Health Technology Co., Ltd., Shenzhen (CN)

(72) Inventor: Xietong Luo, Shenzhen (CN)

(73) Assignee: Shenzhen Axo Health Technology Co., Ltd., Shenzhen (CN)

( * ) Notice: Subject to any disclaimer, the term of this patent is extended or adjusted under 35 U.S.C. 154(b) by 121 days.

(21) Appl. No.: 18/169,247

(22) Filed: Feb. 15, 2023

(65) Prior Publication Data

US 2024/0261628 A1 Aug. 8, 2024

(30) Foreign Application Priority Data

Feb. 7, 2023 (CN) ..... 202320143340.4

(51) Int. Cl.
*A63B 22/02* (2006.01)

(52) U.S. Cl.
CPC ..... *A63B 22/02* (2013.01); *A63B 2225/093* (2013.01)

(58) Field of Classification Search
CPC ..... A63B 22/02–0292; A63B 2225/093
See application file for complete search history.

(56) References Cited

U.S. PATENT DOCUMENTS 759,296 A * 5/1904 Morairty ..... A63B 22/02 482/54
3,643,943 A * 2/1972 Erwin, Jr. ..... A61B 5/221 73/379.06
4,344,616 A * 8/1982 Ogden ..... A63B 22/0023 482/54
D270,555 S * 9/1983 Ogden ..... D21/669
4,406,451 A * 9/1983 Gaetano ..... A61H 15/00 403/113
4,445,683 A * 5/1984 Ogden ..... A63B 22/0023 482/54
4,502,679 A * 3/1985 De Lorenzo ..... A63B 22/0257 482/7
4,776,582 A * 10/1988 Ramhorst ..... A63B 22/0023 482/54
5,007,630 A * 4/1991 Real ..... A63B 22/0023 482/54
5,382,207 A * 1/1995 Skowronski ..... A63B 22/02 482/904

(Continued)

FOREIGN PATENT DOCUMENTS

CN 113101597 A * 7/2021 ..... A63B 22/0207

*Primary Examiner* — Nyca T Nguyen
(74) *Attorney, Agent, or Firm* — Jeenam Park

(57) ABSTRACT

The present application provides a lifting mechanism for a treadmill comprising a running platform and a lifting mechanism for driving the running platform to raise and lower. The lifting mechanism comprises a driving device, a transmission assembly and at least two groups of lifting assemblies. The lifting assembly comprises a lifting screw, lifting nuts, supporting feet, wherein the supporting feet are connected to the lifting nuts and are configured to support the running platform, the driving device and the lifting screw are respectively arranged on the running platform, the driving device drives the lifting screw to rotate through the transmission assembly, and the lifting screw is raised and lowered relative to the lifting nut so that at least one end of the running platform raises and lowers accordingly.

9 Claims, 4 Drawing Sheets

(56) References Cited

U.S. PATENT DOCUMENTS

| | | | | |
|---|---|---|---|---|
| 5,385,520 | A * | 1/1995 | Lepine | A63B 22/0023 482/54 |
| 5,618,245 | A * | 4/1997 | Trulaske | A63B 22/025 482/7 |
| 5,855,537 | A * | 1/1999 | Coody | A63B 22/02 482/54 |
| 7,455,626 | B2 * | 11/2008 | Trevino | A63B 22/0023 482/54 |
| 8,951,167 | B2 * | 2/2015 | Chen | A63B 22/0242 198/806 |
| 2003/0064862 | A1 * | 4/2003 | Hald | A63B 22/0023 482/51 |
| 2013/0123073 | A1 * | 5/2013 | Olson | A63B 22/02 482/54 |
| 2013/0190136 | A1 * | 7/2013 | Watterson | A63B 24/00 482/8 |
| 2015/0217180 | A1 * | 8/2015 | Zhou | A63B 24/0075 482/83 |
| 2023/0191189 | A1 * | 6/2023 | Taylor | A63B 22/02 482/54 |

* cited by examiner

LIFTING MECHANISM FOR TREADMILLS

CROSS-REFERENCE TO RELATED APPLICATIONS

This application claims the benefit and priority of Chinese patent application No. 202320143340.4, filed on Feb. 7, 2023, disclosure of which is hereby incorporated by reference in its enrirety.

TECHNICAL FIELD

The present application belongs to the technical field of fitness equipment, and in particular relates to a lifting mechanism of treadmills.

BACKGROUND

A treadmill is a common indoor fitness equipment. In order to simulate various sports modes such as climbing, at least one end of the base needs to be raised to form a slope.

The existing Chinese patent with the application number CN202110886595.5 discloses a lifting device with a follow-up buffer mechanism for treadmill and a treadmill, comprising a base, a running platform and an angle adjustment structure, the angle adjustment mechanism comprises a hinged seat fixed to the running platform, a pushing part that moves along the length of the base, and a lifting arm hinged between the two. The movement of the pushing part is controlled by the movement of the drive rod, the movement of the drive rod is controlled by the control mechanism. In the prior art such as the above-mentioned scheme, the pushing part moves along the length direction of the base and drives the running platform up and down through the lifting arm. Its driving force arm is long and its structure is complicated, so it requires a large installation space, which increases the overall dead weight of the treadmill and does not meet people's needs for lightweight treadmills.

SUMMARY

In order to achieve the above object, the present application provides a lifting mechanism of a treadmill, comprising a running platform and a lifting mechanism for driving the running platform to raise and lower, wherein the lifting mechanism comprises a driving device, a transmission assembly and at least two groups of lifting assemblies, wherein the lifting assembly comprises a lifting screw, lifting nuts, supporting feet, wherein the supporting feet are connected to the lifting nuts and are configured to support the running platform, the driving device and the lifting screw are respectively arranged on the running platform, the driving device drives the lifting screw to rotate through the transmission assembly, and the lifting screw is raised and lowered relative to the lifting nut so that at least one end of the running platform raises and lowers accordingly.

As preferred: the driving device comprises a drive motor and an output shaft that is drivingly connected to the drive motor, and the transmission assembly comprises a drive wheel that is drivingly connected to the output shaft and a driven wheel that is drivingly connected to the lifting screw, the drive wheel directly or indirectly drives the driven wheel; the running platform comprises a cross rod and two side rods connected to both ends of the cross rod, wherein the inside of the cross rod and the two side rods form an electromechanical mounting area, and a driving device mounting seat is arranged on the cross rod, and the driving device mounting seat comprises a mounting seat body defining a mounting end surface, and a mounting rib configured to be fixedly connected with the cross rod, the mounting rib is located on a side of the mounting seat body, and an output end of the drive motor is fixed on the mounting end surface in a hanging manner; the output shaft rotates around an output axis X, and the lifting screw rotates around a rotation axis Y.

As preferred: the lifting screw comprises an abutting portion, a connecting section and a lifting threaded section respectively formed on both sides of the abutting portion, the connecting section is configured to connect the driven wheel, and the lifting threaded section is configured to match the lifting nut, the abutting portion is configured to abut the running platform to make it raise and lower synchronously with the lifting screw.

As preferred: the lifting assembly further comprises a guiding sleeve, which slides with the lifting nut and forms a circumferential limit on it.

As preferred: the output axis X is parallel to the lifting axis Y, the drive motor is a planetary gear reduction motor, the mounting end surface comprises at least part of the upper surface of the mounting seat body, and an upper end surface of the planetary gear reduction motor is fixedly mounted on the mounting end surface in a hanging manner. The drive motor is installed in the way of upper suspension, which can lower the overall center of gravity of the lifting mechanism, the counterweight is reasonable, and the noise is reduced;

the drive wheel is directly connected to the output shaft by transmission, and the transmission assembly further comprises:

a synchronous belt and a tensioning device configured to form a mechanical limit on the synchronous belt, the synchronous belt is arranged above the electromechanical mounting area and extends along a length direction of the cross rod, which is configured to connect the drive wheel and two groups of driven wheels respectively located at two ends of the cross rod.

As preferred: side rod is provided with a lifting screw fixing seat, and the lifting screw fixing seat is provided with a shaft groove, and the connecting section is equipped with a lifting screw bushing for rotating and matching the shaft groove, and the driven wheel is arranged above the lifting screw fixing seat, the connecting section partially passes through the shaft groove and is connected with the driven wheel;

the side rod comprises an upper surface and a lower surface, the lifting screw fixing seat is arranged on the upper surface, the guiding sleeve is arranged on the lower surface, and the guiding sleeve is aligned with the lifting screw fixing seat.

As preferred: the output axis X is perpendicular to the lifting axis Y, the drive motor is a worm geared motor, and the mounting end surface comprises at least part of side surface of the mounting seat body, and the worm geared motor is obliquely fixed on the mounting end surface in a hanging manner, wherein a mounting angle between the mounting end surface and the vertical plane is $\alpha$, $90° > \alpha > 0°$.

As preferred: the drive wheel and the driven wheel are bevel gear structures, and the transmission assembly further comprises: a hexagonal shaft connecting rod that rotates coaxially with both ends of the output shaft, and the hexagonal shaft connecting rod is arranged above the electromechanical mounting area and extends along the length direction of the cross rod, the drive wheel rotates coaxially with the hexagonal shaft connecting rod, and the driven wheel meshes with the driving wheel.

As preferred: the transmission assembly further comprises a gear box, the gear box is fixedly arranged on the running platform, the drive wheel and the driven wheel are accommodated in the gear box, and one end of the lifting screw extends into the gear box and connected with the driven wheel.

As preferred: the two side rods comprise inner surfaces facing each other, the inner surfaces are provided with the guiding sleeve, and the two side rods are provided with mounting seats, and the gear box is arranged on the mounting seats and extends to be aligned with the guiding sleeve.

The beneficial effect of the present application is: 1. By providing the lifting screw and the lifting nut that cooperate with each other, the driving device can drive the lifting screw to rotate through the transmission assembly without displacement, thereby driving at least one end of the running platform to raise and lower synchronously. The driving force arm is short, and the lifting process is stable and efficient, which has a compact structure and a small installation space, which is conducive to realizing the lightweight of the treadmill. 2. By using the mounting rib and the mounting end surface to fix the motor in a hanging manner, the vibration effect of the drive motor on the cross rod can be reduced, thereby reducing noise and facilitating maintenance and replacement.

REFERENCE SIGNS

101—Driving device, 102—Running platform, 103—Lifting screw, 104—Lifting nut, 105—Supporting foot, 106—Drive wheel, 107—Driven wheel, 108—Output shaft, 109—Synchronous belt, 110—Retaining ring, 111—Abutting part, 112—Connecting section, 113—Lifting threaded section, 114—Lifting screw bushing, 115—Lifting screw fixing seat, 116—Shaft groove, 117—Guiding sleeve, 118—Hexagonal shaft connecting rod, 120—Gear box, 121—Mounting seat, 122—Cross rod, 123—Side rod, 124—Driving device mounting seat, 125—Electromechanical mounting area, 126—Mounting rib, 127—Main driving device, 128—Tensioning part, 129—Mounting seat body, 130—Mounting end surface, 131—Drive motor.

DETAILED DESCRIPTION

In order to make the purpose, technical solution and advantages of the present application clearer, the present application will be described in detail below in conjunction with the accompanying drawings and specific embodiments.

Embodiment 1

Figure 1:
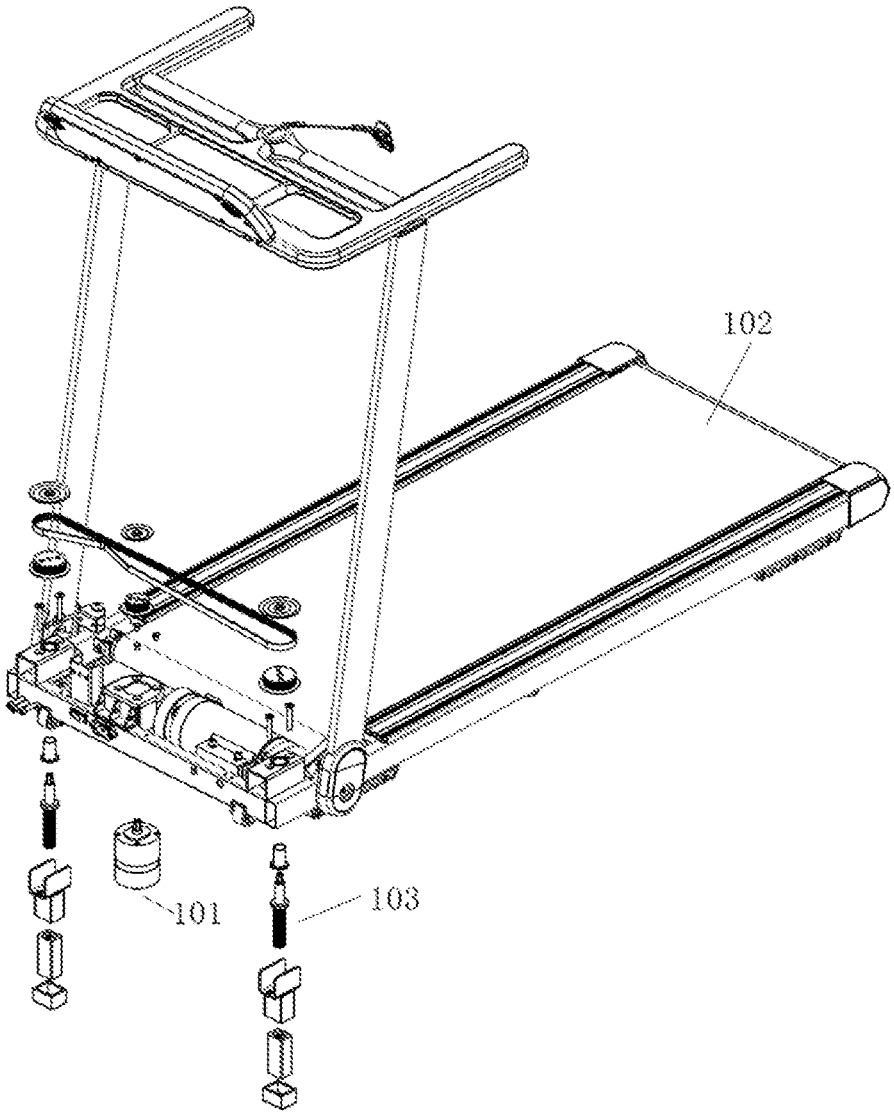
FIG. 1 is an exploded schematic diagram of the lifting mechanism of a treadmill provided in Example 1.
Figure 2:
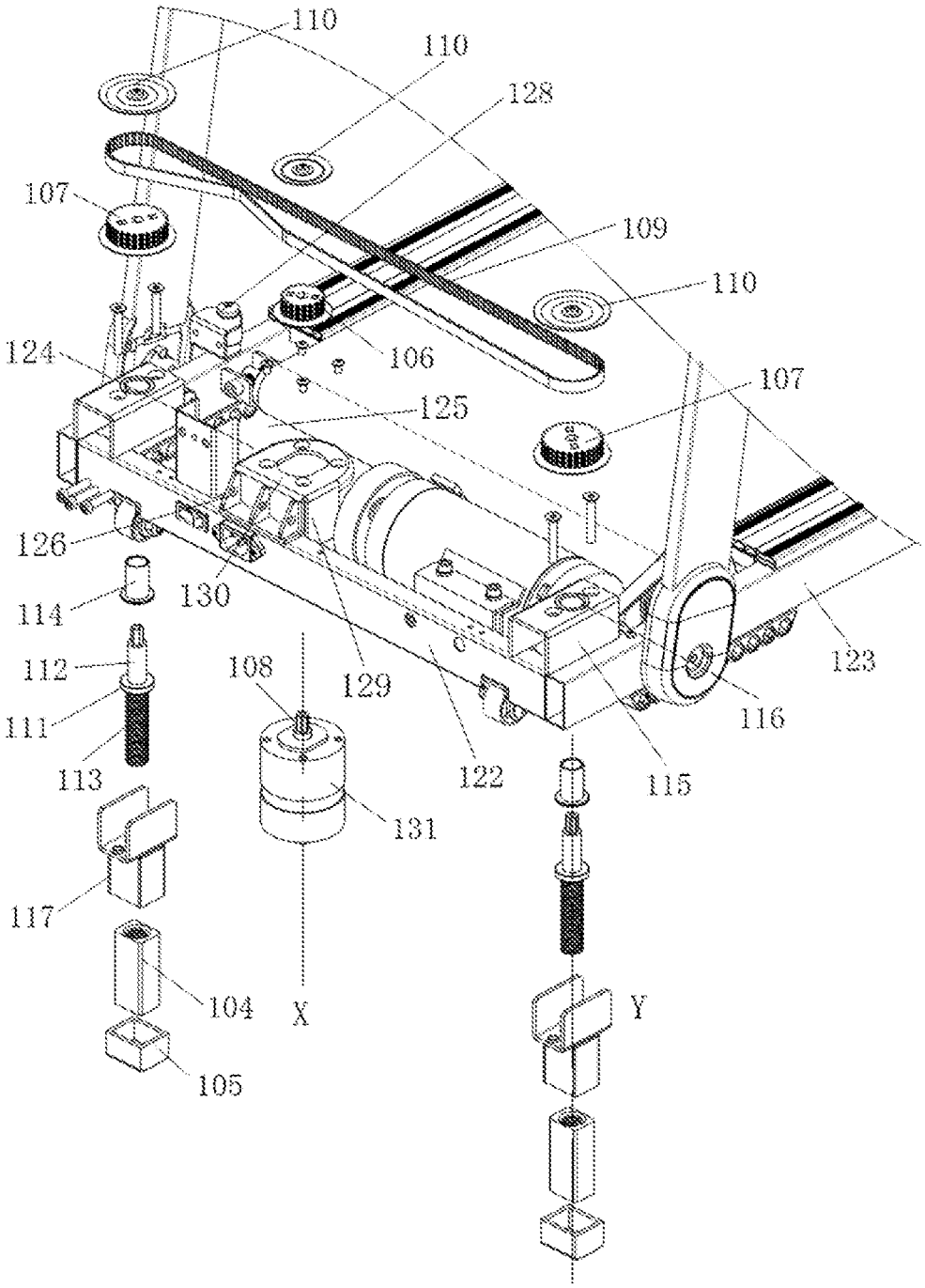
FIG. 2 is an enlarged schematic diagram of a part of FIG. 1.

As shown in FIG. 1-2, a lifting mechanism for a treadmill comprises a running platform 102 and a lifting mechanism for driving the running platform 102 to raise and lower, wherein the lifting mechanism comprises a driving device 101, a transmission assembly and at least two groups of lifting assemblies. The running platform 102 comprises a cross rod 122 and two side rods 123 connected to both ends of the cross rod 122, the driving device 101 is arranged on the cross rod 122, and the transmission assembly and the lifting assembly are arranged on the side rod 123. The lifting assembly comprises a lifting screw 103, lifting nuts 104, supporting feet 105, wherein the supporting feet 105 are connected to the lifting nuts 104 and are configured to support the running platform 102, the driving device 101 and the lifting screw 103 are respectively arranged on the running platform 102, the driving device 101 drives the lifting screw 103 to rotate through the transmission assembly, and the lifting screw 103 is raised and lowered relative to the lifting nut 104 so that at least one end of the running platform 102 raises and lowers accordingly.

In the present embodiment, the driving device 101 comprises a drive motor 131 and an output shaft 108 that is drivingly connected with the drive motor 131, and the transmission assembly comprises a drive wheel 106 that is drivingly connected to the output shaft 108 and a driven wheel 107 that is drivingly connected to the lifting screw 103, the drive wheel 106 directly or indirectly drives the driven wheel 107. The running platform comprises a cross rod 122 and two side rods 123 connected to both ends of the cross rod 122, wherein the inside of the cross rod 122 and the two side rods 123 form an electromechanical mounting area 125, and a driving device mounting seat 124 is arranged on the cross rod 122, and the driving device mounting seat 124 comprises a mounting seat body 129, and a mounting rib 126 configured to be fixedly connected with the cross rod 122, the mounting rib 126 is located on a side of the mounting seat body 129, and an upper surface of the mounting seat body 129 defines a mounting end surface 130. An output end 108 of the drive motor 131 is fixed on the mounting end surface 130 in a hanging manner. The output shaft 108 rotates around an output axis X, and the lifting screw 103 rotates around a rotation axis Y.

The output axis X is parallel to the lifting axis Y, the driving device is a planetary gear reduction motor. An upper end surface of the planetary gear reduction motor is fixedly mounted on the mounting end surface 130 in a hanging manner. By installing the drive motor 131 in a hanging manner, the whole center of gravity of the lifting mechanism can be lowered, the counterweight is reasonable, and the noise can be reduced. The drive wheel 106 is directly connected to the output shaft 108 by transmission, and the transmission assembly further comprises: a synchronous belt 109 and a tensioning device 128 configured to form a mechanical limit on the synchronous belt 109, which improves the tension of the synchronous belt 109, increases the meshing size of the synchronous belt 109 with the drive wheel 106 and the driven wheel 107, and improves the transmission stability of the synchronous belt 109. The synchronous belt 109 is arranged above the electromechanical mounting area 125 and extends along a length direction of the cross rod 122, which is configured to connect the drive wheel 106 and two groups of driven wheels 107 respectively located at two ends of the cross rod 122. Further, the driv2 wheel 106 and the driven wheel 107 are respectively equipped with retaining rings 110 for limiting the synchronous belt 109.

In the present embodiment, the lifting screw 103 comprises an abutting portion 111, a connecting section 112 and a lifting threaded section 113 respectively formed on both sides of the abutting portion 111. The side rod 123 comprises an upper surface and a lower surface, the lifting screw fixing seat 115 is arranged on the upper surface. A guiding sleeve is arranged on the lifting screw fixing seat 115. The connecting section 112 is equipped with a lifting screw bushing 114 for rotating and matching the shaft groove 116, and the driven wheel 107 is arranged above the lifting screw fixing seat 115, the connecting section 112 partially passes through the shaft groove 116 and is connected with the driven wheel 107 and the lifting threaded section 113 cooperates with the lifting nut 104. The lower surface is provided with a guiding sleeve 117, and the guiding sleeve 117 is aligned with the lifting screw fixing seat. The guiding sleeve 117 is slidably matched with the lifting nut 104 and forms a circumferential limit to it, so that the lifting screw 103 is lifted upward during the rotation process. During this process, the upper edge of the abutting part 111 abuts against the lifting screw fixing seat 115, so that the running platform 102 is lifted synchronously with the lifting screw 103, and when the lifting screw 103 is lowered, combined with the action of gravity, the running platform 102 can be lowered accordingly.

Embodiment 2

Figure 3:
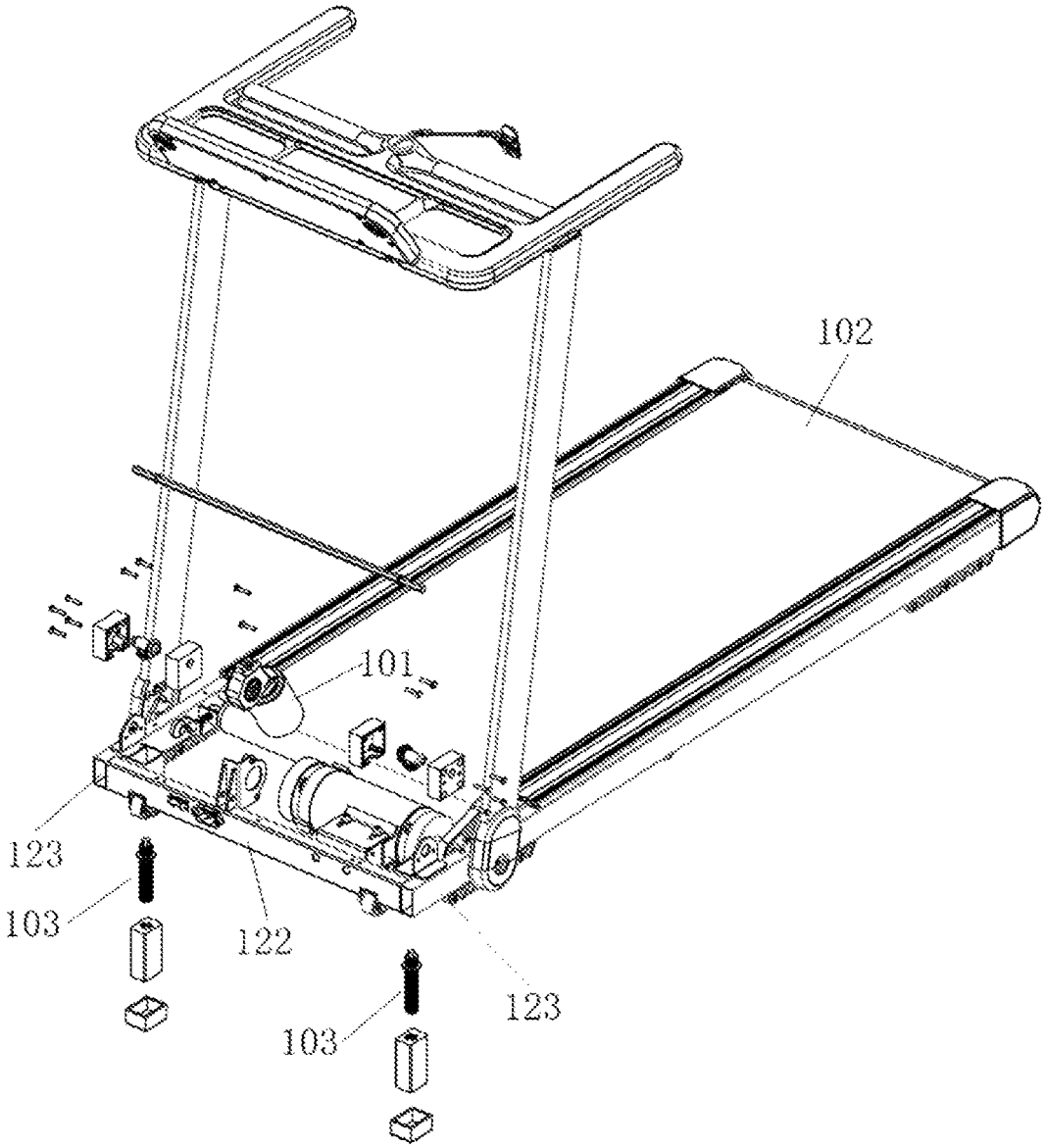
FIG. 3 is an exploded schematic diagram of the lifting mechanism of a treadmill provided in Example 2.
Figure 4:
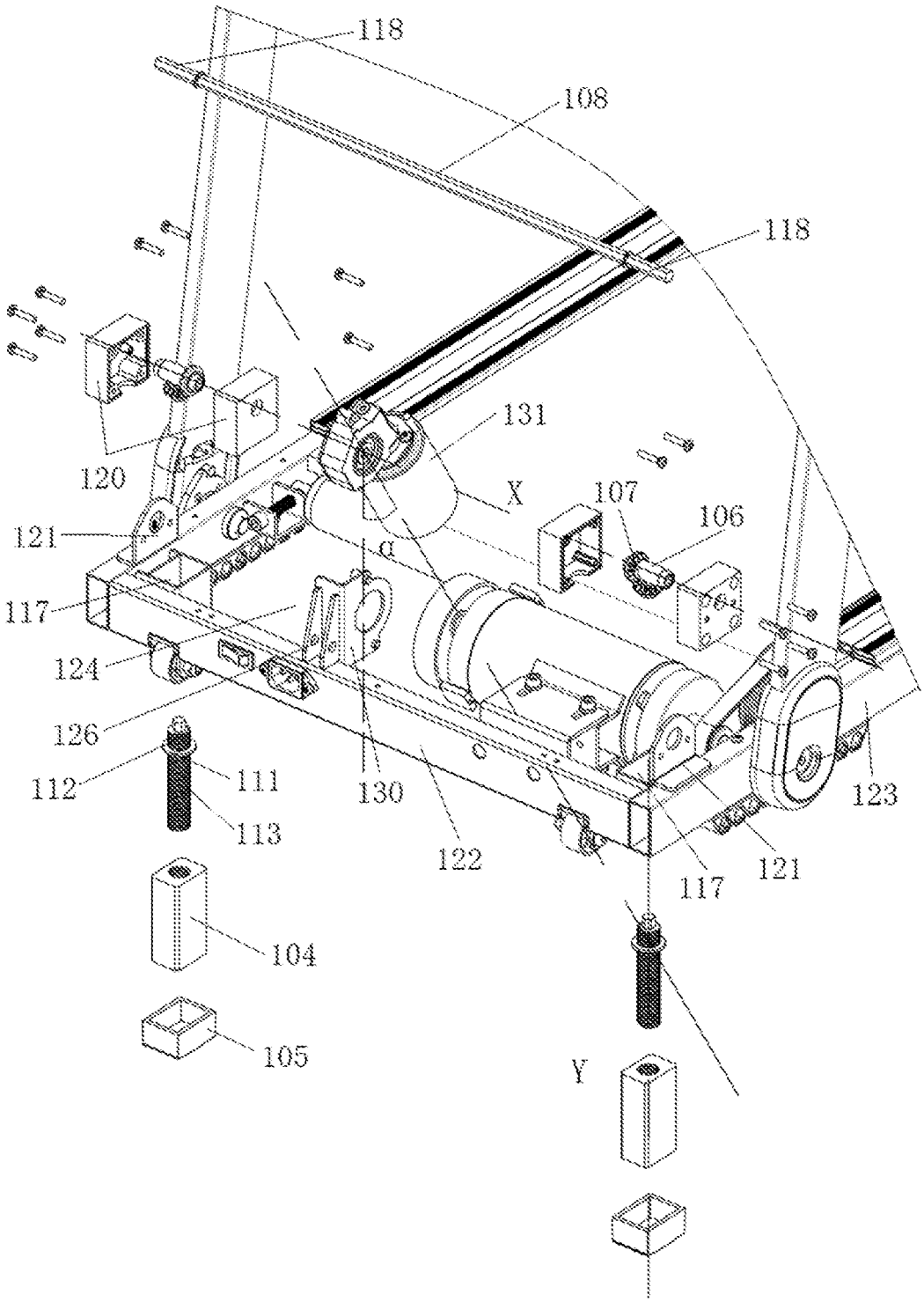
FIG. 4 is an enlarged schematic diagram of a part of the area in FIG. 3.

As shown in FIGS. 3-4, the lifting mechanism of a treadmill is different from that in Embodiment 1 in that the output axis X is perpendicular to the lifting axis Y. The drive motor 131 is a worm geared motor, at least part of the side surface of the mounting seat body 129 forms the mounting end surface 130, the worm geared motor is obliquely fixed to the mounting end face 130 in a hanging manner, and a mounting angle between the mounting end surface and the vertical plane is $\alpha$, and $\alpha$ is 30°.

In the present embodiment, the drive wheel 106 and the driven wheel 107 are bevel gear structures, and the transmission assembly further comprises: a gearbox 120 for accommodating the drive wheel 106 and the driven wheel 107, and a hexagonal shaft connecting rod 118 that rotates coaxially with both ends of the output shaft 108, and the hexagonal shaft connecting rod 118 is arranged above the electromechanical mounting area 125 and extends along the length direction of the cross rod 122, the drive wheel 106 rotates coaxially with the hexagonal shaft connecting rod 115, and the driven wheel 107 meshes with the driving wheel 106. The lifting screw 103 comprises an abutting portion 111, a connecting section 112 and a lifting threaded section 113 respectively formed on both sides of the abutting portion 111. The connecting section 112 extends into the gear box 120 and is connected with the driven wheel 107.

In the present embodiment, the two side rods 123 are provided with mounting seats 121, and the gear box 120 is arranged on the mounting seats 121. The two side rods 123 comprise inner surfaces facing each other, the inner surfaces are provided with the guiding sleeve 117. The gear box 120 extends to be aligned with the guiding sleeve 117. The guiding sleeve 117 slides with the lifting nut 104 and forms a circumferential limit on it, so that the lifting screw 103 is lifted upward during the rotation. During this process, the upper edge of the abutting portion 111 abuts against the gear box 120, so that the running platform 102 is lifted synchronously with the lifting screw 103, and when the lifting screw 103 is lowered, combined with the action of gravity, the running platform 102 can be lowered accordingly.

What is claimed is:

1. A lifting mechanism for a treadmill comprising a running platform and a lifting mechanism for driving the running platform to raise and lower, wherein the lifting mechanism comprises: a driving device, a transmission assembly and at least two groups of lifting assemblies, wherein each said lifting assembly comprises a lifting screw, lifting nuts, supporting feet, wherein the supporting feet are connected to the lifting nuts and are configured to support the running platform, the driving device and the lifting screw are respectively arranged on the running platform, the driving device drives the lifting screw to rotate through the transmission assembly, and the lifting screw is raised and lowered relative to the lifting nuts so that at least one end of the running platform raises and lowers accordingly;

wherein the driving device comprises a drive motor and an output shaft that is drivingly connected to the drive motor, and the transmission assembly comprises a drive wheel that is drivingly connected to the output shaft and a driven wheel that is drivingly connected to the lifting screw, the drive wheel directly or indirectly drives the driven wheel;

the running platform comprises a cross rod and two side rods connected to both ends of the cross rod, wherein an inside of the cross rod and the two side rods form an electromechanical mounting area, and a driving device mounting seat is arranged on the cross rod, the driving device mounting seat comprises a mounting seat body defining a mounting end surface, and a mounting rib configured to be fixedly connected with the cross rod, the mounting rib is located on a side of the mounting seat body, and an output end of the drive motor is fixed on the mounting end surface in a hanging manner;

the output shaft rotates around an output axis X, and the lifting screw rotates around a rotation axis Y.

2. The lifting mechanism for a treadmill according to claim 1, wherein the lifting screw comprises an abutting portion, a connecting section and a lifting threaded section respectively formed on both sides of the abutting portion, the connecting section is configured to connect the driven wheel, and the lifting threaded section is configured to match the lifting nuts, the abutting portion is configured to abut the running platform to make it raise and lower synchronously with the lifting screw.

3. The lifting mechanism for a treadmill according to claim 2, wherein each said lifting assembly further comprises a guiding sleeve, which slides with the lifting nuts and forms a circumferential limit on it.

4. The lifting mechanism for a treadmill according to claim 3, wherein the output axis X is parallel to the lifting axis Y, the drive motor is a planetary gear reduction motor, the mounting end surface comprises at least part of an upper surface of the mounting seat body, and an upper end surface of the planetary gear reduction motor is fixedly mounted on the mounting end surface in a hanging manner, the drive wheel is directly connected to the output shaft by transmission, and the transmission assembly further comprises:

a synchronous belt and a tensioning device configured to form a mechanical limit on the synchronous belt, the synchronous belt is arranged above the electromechanical mounting area and extends along a length direction of the cross rod, which is configured to connect the drive wheel and two groups of driven wheels respectively located at two ends of the cross rod.

5. The lifting mechanism for a treadmill according to claim 4, wherein each side rod is provided with a lifting screw fixing seat, and the lifting screw fixing seat is provided with a shaft groove, and the connecting section is equipped with a lifting screw bushing for rotating and matching the shaft groove, and the driven wheel is arranged above the lifting screw fixing seat, the connecting section partially passes through the shaft groove and is connected with the driven wheel;

each said side rod comprises an upper surface and a lower surface, the lifting screw fixing seat is arranged on the upper surface, the guiding sleeve is arranged on the lower surface, and the guiding sleeve is aligned with the lifting screw fixing seat.

6. The lifting mechanism for a treadmill according to claim 3, wherein the output axis X is perpendicular to the lifting axis Y, the drive motor is a worm geared motor, and the mounting end surface comprises at least part of side surface of the mounting seat body, and the worm geared motor is obliquely fixed on the mounting end surface in a hanging manner, wherein a mounting angle between the mounting end surface and a vertical plane is $\alpha$, $90° > \alpha > 0°$.

7. The lifting mechanism for a treadmill according to claim 6, wherein the drive wheel and the driven wheel are bevel gear structures, and the transmission assembly further comprises:

a hexagonal shaft connecting rod that rotates coaxially with both ends of the output shaft, and the hexagonal shaft connecting rod is arranged above the electromechanical mounting area and extends along a length direction of the cross rod, the drive wheel rotates coaxially with the hexagonal shaft connecting rod, and the driven wheel meshes with the drive wheel.

8. The lifting mechanism for a treadmill according to claim 7, wherein the transmission assembly further comprises a gear box, the gear box is fixedly arranged on the running platform, the drive wheel and the driven wheel are accommodated in the gear box, and one end of the lifting screw extends into the gear box and connected with the driven wheel.

9. The lifting mechanism for a treadmill according to claim 8, wherein the two side rods comprise inner surfaces facing each other, the inner surfaces are provided with the guiding sleeve, and the two side rods are provided with mounting seats, and the gear box is arranged on the mounting seats and extends to be aligned with the guiding sleeve.

* * * * *